US011460187B1

(12) United States Patent
Acosta

(10) Patent No.: US 11,460,187 B1
(45) Date of Patent: Oct. 4, 2022

(54) MIRROR SYSTEM AND METHOD OF USE

(71) Applicant: Carol Sloan Acosta, Arlington, TX (US)

(72) Inventor: Carol Sloan Acosta, Arlington, TX (US)

( * ) Notice: Subject to any disclaimer, the term of this patent is extended or adjusted under 35 U.S.C. 154(b) by 0 days.

(21) Appl. No.: 16/736,435

(22) Filed: Jan. 7, 2020

Related U.S. Application Data

(60) Provisional application No. 62/789,224, filed on Jan. 7, 2019.

(51) Int. Cl.
*F21V 33/00* (2006.01)
*A47G 1/16* (2006.01)
*F21Y 115/15* (2016.01)

(52) U.S. Cl.
CPC ..... *F21V 33/0096* (2013.01); *A47G 1/16* (2013.01); *F21V 33/0012* (2013.01); *A47G 2001/1673* (2013.01); *F21Y 2115/15* (2016.08)

(58) Field of Classification Search
CPC .. F21W 2131/302; F21V 33/004; A47G 1/02; A45D 42/10
See application file for complete search history.

(56) References Cited

U.S. PATENT DOCUMENTS 5,997,149 A * 12/1999 Chu ..... A45D 42/10 362/142
2010/0118520 A1* 5/2010 Stern ..... A45D 42/10 362/135
2013/0235607 A1* 9/2013 Yang ..... F21V 33/0004 362/551
2015/0060431 A1* 3/2015 Yang ..... H05B 3/845 219/219
2016/0255941 A1* 9/2016 Yang ..... A45D 42/18
2018/0263362 A1* 9/2018 Yang ..... A47G 1/04
2019/0267825 A1* 8/2019 Chien ..... H01R 13/6691
2019/0291647 A1* 9/2019 Yang ..... G06F 3/167

FOREIGN PATENT DOCUMENTS

CN 207125466 U * 3/2018

* cited by examiner

*Primary Examiner* — Alexander K Garlen
(74) *Attorney, Agent, or Firm* — Eldredge Law Firm

(57) ABSTRACT

A make-up mirror system having a mirror, a LED light system integrated around a circumferential edge of the mirror, a fan integrated around the circumferential edge of the LED light system, and a control system which activates the LED light system and the fan based on user commands.

10 Claims, 4 Drawing Sheets

MIRROR SYSTEM AND METHOD OF USE

BACKGROUND

1. Field of the Invention

The present invention relates generally to a mirror system and methods of use. More specifically, the invention is related to a system and method for applying make-up utilizing a mirror that has a set of integrated lights, a fan and magnification.

2. Description of Related Art

Systems and methods for mirrors are well known in the art. At times, it is required to apply make-up or perform other beauty techniques such as tweezing that require a great amount of precision and accuracy. FIG. 1 depicts a conventional vanity system 101 comprising a standard wall mirror 103, a set of vanity lights 105, a cabinet base 107 with countertop 111 and sink, including a sink faucet 109. To apply make-up utilizing this system, the user must use the available mirror which offers no magnification and is stationary.

One of the problems commonly associated with process 101 is the limited use. It is often difficult to apply make up in this setting because a person must lean over the countertop 111 and sink to be close enough to the wall mirror 103 to see properly. Additionally, the mirror 103 offer no magnification for areas that require more precision. The vanity lights 105 are usually standard light bulbs that can often give off too yellow, too bright or too dim of a light. It is then difficult to tell how one's make-up will appear in natural sunlight or even rooms lit by other types of lights.

Although great strides have been made in the area of mirror systems and methods of use, many shortcomings remain.

DESCRIPTION OF THE DRAWINGS

The novel features believed characteristic of the embodiments of the present application are set forth in the appended claims. However, the embodiments themselves, as well as a preferred mode of use, and further objectives and advantages thereof, will best be understood by reference to the following detailed description when read in conjunction with the accompanying drawings, wherein:

Figure 1:
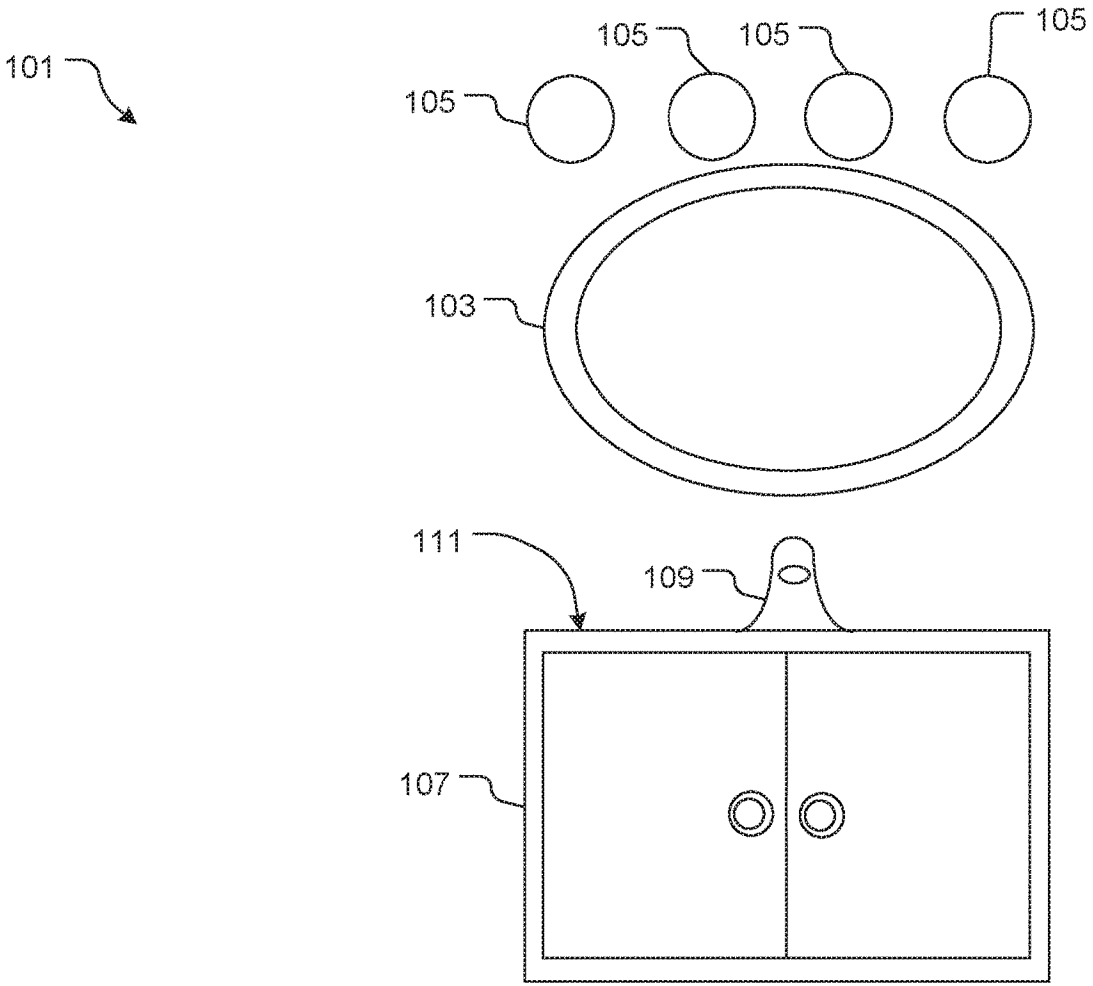
FIG. 1 (Prior Art)
FIG. 1 is a simplified schematic of a conventional system for a vanity mirror.

While the system and method of use of the present application is susceptible to various modifications and alternative forms, specific embodiments thereof have been shown by way of example in the drawings and are herein described in detail. It should be understood, however, that the description herein of specific embodiments is not intended to limit the invention to the particular embodiment disclosed, but on the contrary, the intention is to cover all modifications, equivalents, and alternatives falling within the spirit and scope of the present application as defined by the appended claims.

DETAILED DESCRIPTION OF THE PREFERRED EMBODIMENT

Illustrative embodiments of the system and method of use of the present application are provided below. It will of course be appreciated that in the development of any actual embodiment, numerous implementation-specific decisions will be made to achieve the developer's specific goals, such as compliance with system-related and business-related constraints, which will vary from one implementation to another. Moreover, it will be appreciated that such a development effort might be complex and time-consuming, but would nevertheless be a routine undertaking for those of ordinary skill in the art having the benefit of this disclosure.

The system and method of use in accordance with the present application overcomes one or more of the above-discussed problems commonly associated with conventional systems and methods for make-up mirrors. Specifically, the present invention is directed to a portable make up mirror that has an integrate system of lights, a fan and magnification. These and other unique features of the system and method of use are discussed below and illustrated in the accompanying drawings.

The system and method of use will be understood, both as to its structure and operation, from the accompanying drawings, taken in conjunction with the accompanying description. Several embodiments of the system are presented herein. It should be understood that various components, parts, and features of the different embodiments may be combined together and/or interchanged with one another, all of which are within the scope of the present application, even though not all variations and particular embodiments are shown in the drawings. It should also be understood that the mixing and matching of features, elements, and/or functions between various embodiments is expressly contemplated herein so that one of ordinary skill in the art would appreciate from this disclosure that the features, elements, and/or functions of one embodiment may be incorporated into another embodiment as appropriate, unless described otherwise.

Figure 2:
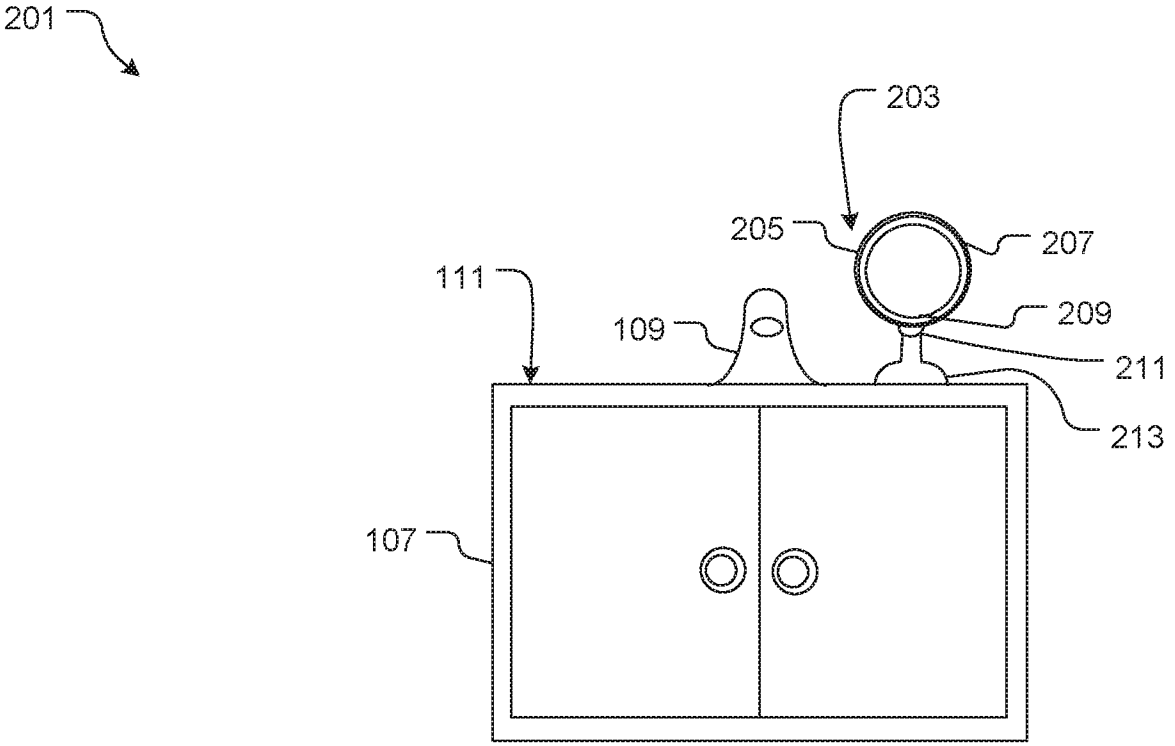
FIG. 2 is a simplified schematic of a system and method of the present invention in accordance with the preferred embodiment of the present invention.

Referring now to the drawings wherein like reference characters identify corresponding or similar elements throughout the several views, FIG. 2 depict various views of a system 201 and method of use in accordance with a preferred embodiment of the present application. It will be appreciated that system 201 overcomes one or more of the above-listed problems commonly associated with the conventional systems and methods to deliver packages.

In the contemplated embodiment, system 201 is contemplated utilizing a portable magnified mirror 209 with a fan 205 and integrated lights 207 to overcome the problems associated with system 101.

Referring now to FIG. 2 system 201 is shown having a cabinet base 107 with a countertop 111 which houses a sink with a sink faucet 109. The present invention is depicted as being removably attached to the countertop 111 via a suction cup 213. The present invention is a make-up mirror system 203 that comprises a circular magnified mirror 209, a circumferential fan 205 and a set of integrated lights 207 also located circumferentially around the magnified mirror 209.

Figure 4:
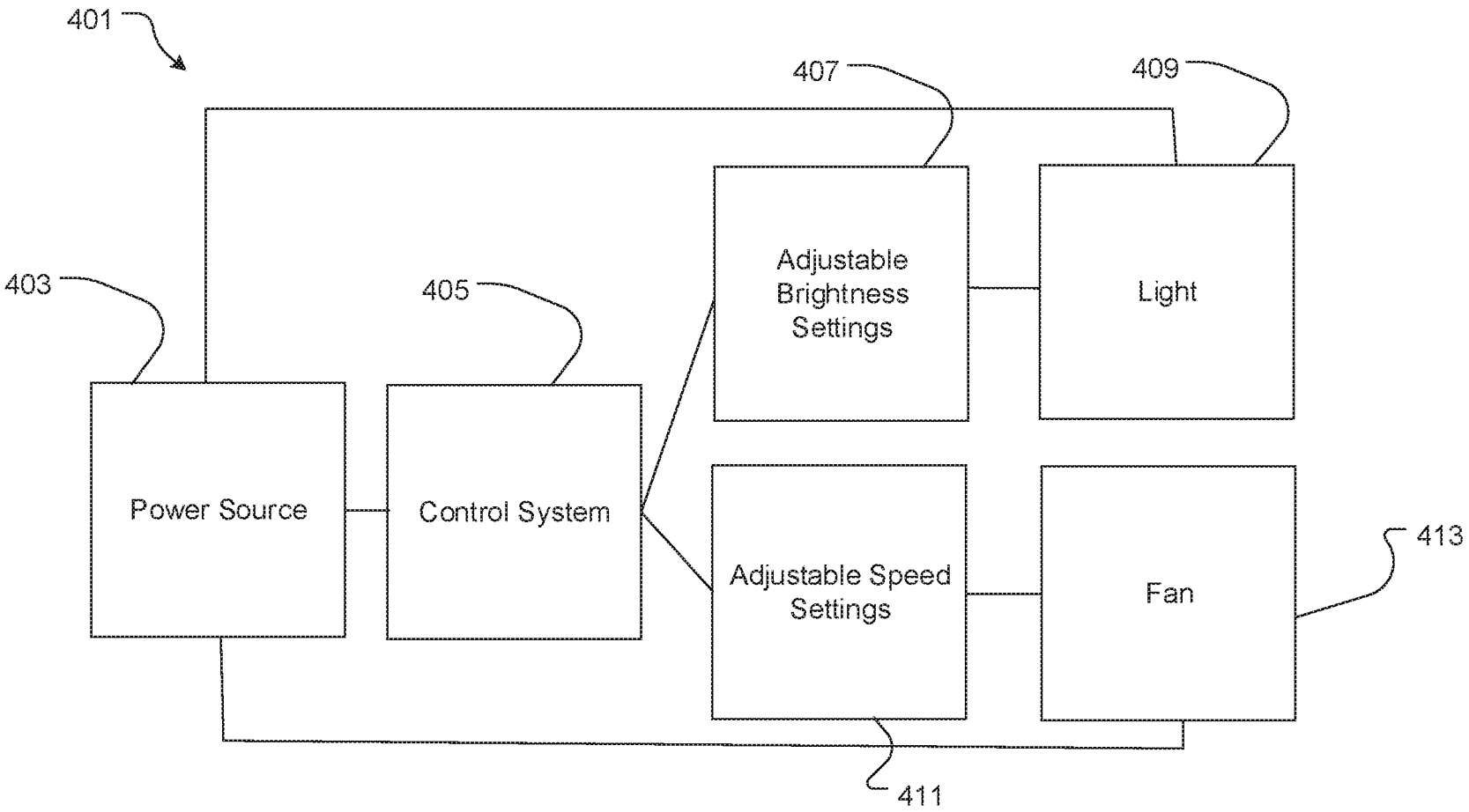
FIG. 4 is a simplified schematic of the powered control system of the system of FIG. 2.

Referring to FIG. 4, a schematic of the powered control system 401 is shown. It is contemplated that the fan could be powered by batteries or an internal rechargeable battery 403. The fan 413 could also be configured to have variable speeds 411 and powers such that the user can adjust the speed via a dial at the base of the mirror. The natural white light helps to reflect true colors. In addition, the light source surrounding the mirror does not cast any shadows on the face. In the preferred embodiment, the mirror could be of 10× magnification which is ideal for applying make-up and other beauty treatments that require more precision such as applying contact lenses and eyebrow tweezing.

The make-up mirror 203 is portable and can be attached to any surface conducive to a suction cup, including a countertop, window, wall, or wall mirror. The magnified mirror 209 can be moved to a desirable location in relation to the suction cup stand via a 360 degree swivel joint 211. This swivel joint 211 allows easy movement of the mirror's face for great viewing at any angle.

In an alternate embodiment, it is contemplated that the mirror system 201 could be configured as a built-in system for bathrooms, powder rooms, and vanity furniture.

In a further embodiment, the mirror system 201 could also be configured to comprise a circumferential sprayer that could spray a make-up setting spray at the touch of a button or other touch sensor switch. This is advantage because after the user has finished applying make-up, often it is difficult to get an even spray of the setting spray, but the circumferential sprayer would assist in providing an even, light layer of the setting spray.

In a further contemplated embodiment, the mirror system 201 could also be configured to comprise a diffuser for essential oils in the base of the stand.

Figure 3:
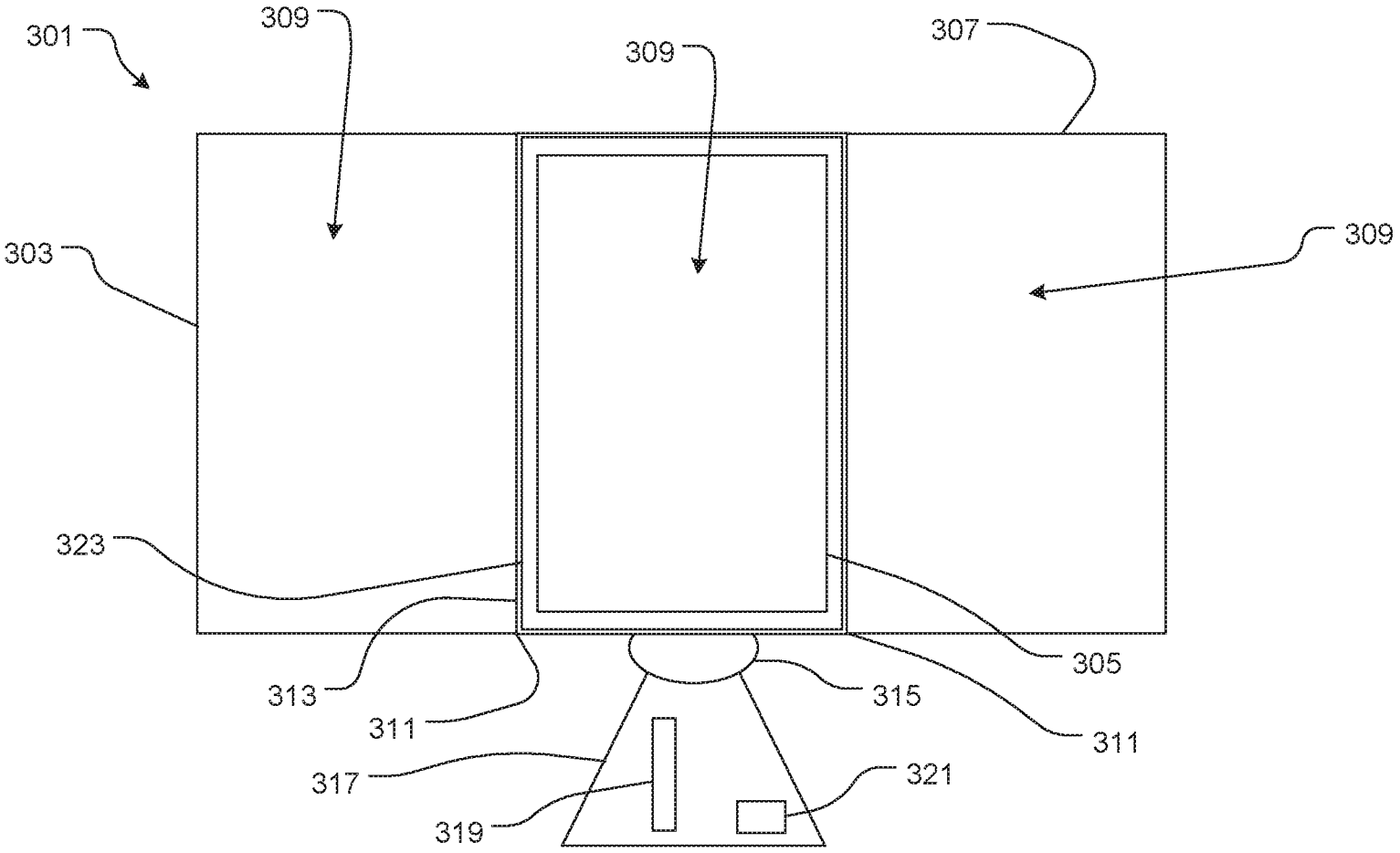
FIG. 3 is a front view of an alternate embodiment of the present invention of the system of FIG. 2.

Referring to FIG. 3, the mirror system 201 in FIG. 2 is shown in an alternate embodiment. Namely, the mirror system 301 is shown having a rectangular mirror comprised of three mirror panels 303, 305, 307 which offer wide-angle viewing for the user to clearly see his or her facial features and make a more perfect make up for each detail to be taken care of. The three sections are configured as a left side mirror panel 303, middle mirror panel 305 and right side mirror panel 307. The left and right sides 303, 307 are connected to either side of the middle panel 309 via a vertical hinge 311 that allows the three mirror panels to be in a tri-fold configuration, wherein the left and right mirror panels can fold inward on top of the middle mirror panel 305. Each of the mirror panels 303, 305, 307 is designed with a premium quality coating 309 that protects the mirror surface and offers a more sleek and polished reflection than standard mirror products. Each of the mirror panels may be configured to reflect varying levels of magnification; for example, a 1×, 2×, and 3× system or any other suitable configuration of magnification.

The rectangular mirror system 301 as shown in FIG. 3, also is depicted as having a 180-degree swivel joint 315 connected to the middle mirror panel 305. This allows the make up mirror system 301 to be freely adjusted and fixed to a comfortable viewing angle. The swivel joint 315 connects the middle mirror panel 305 to the base stand 317 of the mirror system. In the depicted embodiment, an LED light system 323 is integrated into the circumferential edge of the middle mirror panel 305. Additionally, a fan 313 is integrated around the LED light system 323 forming the outer edge of the middle mirror panel 305.

In one contemplated embodiment, the LED light system 323 is formed from a set of twenty-one LED pieces that can be adjusted in brightness via a touch sensor dial 319 located in the base stand 317 of the mirror system 301. In an alternate embodiment, both the fan 313 and the LED light system 323 could be configured to be integrated around the entire circumferential edge of the mirror system, including all three mirror panels 303, 305, 307. Alternatively, the LED light system 323 could be configured as two vertical sets of LED lights along the hinges 311.

Referring to FIG. 4, the powered control system is shown having a power source 403, a control system or controller 405, adjustable brightness settings 407 and the light source 409.

In a further contemplated embodiment, the fan 313 could be integrated into the base stand 317.

The base stand 317 also houses a USB port 321 for charging, and alternatively, a compartment for battery placement so that the mirror system can either be operated by four AAA batteries or a USB cable. A suction cup is located the bottom of the base stand so that the mirror system 301 can be secured to any clean, flat surface for detachable placement.

In an alternate embodiment, the rectangular or square mirror system 301 could be configured to be integrated into an existing vanity or bathroom mirror and cabinet system.

The particular embodiments disclosed above are illustrative only, as the embodiments may be modified and practiced in different but equivalent manners apparent to those skilled in the art having the benefit of the teachings herein. It is therefore evident that the particular embodiments disclosed above may be altered or modified, and all such variations are considered within the scope and spirit of the application. Accordingly, the protection sought herein is as set forth in the description. Although the present embodiments are shown above, they are not limited to just these embodiments, but are amenable to various changes and modifications without departing from the spirit thereof.

What is claimed is:

1. A make-up mirror system comprising:

a left mirror panel having a first magnification;

a middle mirror panel having a second magnification and attached to the left mirror via a vertical hinge;

a right mirror panel having a third magnification and attached to the middle mirror panel via a vertical hinge, the second magnification is different from the third magnification;

a LED light system integrated around an entire circumferential edge of the middle mirror;

a fan integrated around the entire circumferential edge of the LED light system; and a control system configured to activate the LED light system and the fan based on user commands;

wherein the left mirror panel and the right mirror panel may fold onto the middle mirror panel in a collapsible tri-fold configuration.

2. The make-up mirror system of claim 1, further comprising:

a base stand;

a 360-degree swivel joint connecting the base stand to the mirror.

3. The make-up mirror system of claim 1, further comprising:

a suction cup located at the bottom of the base stand.

4. The make-up mirror system of claim 2, further comprising:

a USB port; and a battery compartment;

wherein the fan and LED light system could be powered via removable batteries within the battery compartment or a USB cable.

5. The make-up mirror system of claim 1, further comprising:

a controller configured to control the fan; and wherein the fan is configured to have adjustable speeds.

6. The make-up mirror system of claim 1, wherein the LED light system is configured to have adjustable brightness settings.

7. The make-up mirror system of claim 1, wherein the LED light system comprises a set of twenty-one LED adjustable light pieces.

8. The make-up mirror system of claim 1, wherein the left mirror panel, the middle mirror panel and right mirror panel further comprise varying magnifications.

9. The make-up mirror system of claim 1, further comprising:

a base stand;

a 180-degree swivel joint that connects the middle mirror panel to the base stand.

10. The make-up mirror system of claim 1, further comprising:

a protective coating layer configured to protect the mirror surface.

* * * * *